US006445113B1

(12) United States Patent
Seko et al.

(10) Patent No.: US 6,445,113 B1
(45) Date of Patent: Sep. 3, 2002

(54) FIELD EMISSION COLD CATHODE DEVICE AND METHOD OF MANUFACTURING THE SAME

(75) Inventors: Nobuya Seko; Yoshinori Tomihari, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/275,811

(22) Filed: Mar. 25, 1999

(30) Foreign Application Priority Data

Mar. 26, 1998 (JP) ..... 10-079946

(51) Int. Cl.[7] ..... H01J 1/30; H01J 1/304
(52) U.S. Cl. ..... 313/309; 313/336; 313/351
(58) Field of Search ..... 313/495, 496, 313/497, 309, 310, 336, 351, 422; 315/169.3; 445/24

(56) References Cited

U.S. PATENT DOCUMENTS

| | | | | | |
|---|---|---|---|---|---|
| 5,194,780 | A | * | 3/1993 | Meyer | 315/169.3 |
| 5,502,347 | A | * | 3/1996 | Dworsky et al. | 313/309 |
| 5,589,728 | A | * | 12/1996 | Levine et al. | 313/336 |
| 5,717,275 | A | * | 2/1998 | Takemura | 313/309 |
| 5,759,078 | A | * | 6/1998 | Levine et al. | 445/24 |
| 6,084,341 | A | * | 7/2000 | Takemura | 313/336 |

FOREIGN PATENT DOCUMENTS

| | | |
|---|---|---|
| JP | 63143731 | 6/1988 |
| JP | 467613 | 3/1992 |
| JP | 4249025 | 9/1992 |
| JP | 4261012 | 9/1992 |
| JP | A 4-261012 | 9/1992 |
| JP | 5144370 | 6/1993 |
| JP | 7161283 | 6/1995 |
| JP | 878637 | 3/1996 |
| JP | 8202018 | 8/1996 |
| JP | 8212907 | 8/1996 |
| JP | A 8-212907 | 8/1996 |
| JP | 950758 | 2/1997 |
| JP | 9180625 | 7/1997 |
| JP | 9293449 | 11/1997 |
| JP | 1050201 | 2/1998 |
| JP | 10-50201 | 2/1998 |
| JP | A 10-50201 | 2/1998 |

* cited by examiner

*Primary Examiner*—Nimeshkumar D. Patel
*Assistant Examiner*—Karabi Guharay
(74) *Attorney, Agent, or Firm*—Young & Thompson

(57) ABSTRACT

In a field emission cold cathode device having a block defined by a contour and a plurality of holes arranged in the block, each hole is uniform in shape to obtain a uniform electric current in the block when emitter cones are located in the uniform holes. A distorted hole is not arranged in the block or holes which are susceptible to be distorted are shifted or moved to other zones which are not distorted. Such uniform holes can be also obtained by preparing mask patterns of different sizes and by transcribing the mask patterns onto photoresist.

9 Claims, 6 Drawing Sheets

FIELD EMISSION COLD CATHODE DEVICE AND METHOD OF MANUFACTURING THE SAME

BACKGROUND OF THE INVENTION

This invention relates to a field emission cold cathode device which has a gate electrode and emitter electrodes to emit electrons from the emitter electrodes by generating an electric field between the gate and the emitter electrodes and a method of manufacturing the same.

In general, requirements have been directed to an effective electron source, in a very small vacuum tube or the like, which is used in a display device, or a high speed switching element. Conventionally, a thermionic electron emission device which emits thermionic electrons by heating a filament has been very often used as such an electron source. However, the thermionic electron emission device has shortcomings that it is objectionably large in energy loss and must be previously heated. Under the circumstances, a recent trend is directed to another electron source instead of the thermionic electron emission device.

In lieu of the thermionic electron emission device, proposals have been made about a field emission cold cathode device which can emit electrons without heating. An example of such field emission cold cathode device has a semiconductor substrate, an insulator layer on the semiconductor substrate, and a gate electrode formed on the insulator layer. Specifically, the gate electrode and the insulator layer are opened to form holes in which emitter electrodes are arranged in place in the form of emitter cones.

With this structure, electrons can be emitted from each top of the emitter cones by impressing an electric voltage between the gate and the emitter electrodes and by generating an electric field of high intensity.

Heretofore, a field emission cold cathode device is disclosed in Japanese Unexamined Patent Publication No. Hei. 8-166,846, namely, 106,846/1996 (will be called Reference 1 hereinafter). The disclosed field emission cold cathode device has a plurality of emitter cones formed within holes and surrounded by an insulator layer and a gate electrode for encircling the emitter cones. In addition, the gate electrode is surrounded by a groove or trench which is formed in the insulator layer placed at a peripheral portion of the gate electrode.

When an insulating material is buried into the trench with this structure, a leak current can be reduced which is caused to inevitably flow in each element of the field emission cold cathode device.

Alternatively, the present inventors have pointed out in the Japanese Unexamined Patent Publication No. Hei 10-50, 201, namely, 50,201/1998 (will be referred to as Reference 2) that a strong electric field between the gate electrode and the emitter electrodes brings about a discharge between the gate electrode and the emitter electrodes during the electron emission even when the trench is formed around the gate electrode. Such a discharge gives rise to breakage of the emitter cones and the like and a large noise.

In order to avoid such a discharge, Reference 2 proposes to prevent a semiconductor substrate from becoming low in electric resistance by digging a trench on the semiconductor substrate right under the emitter cones and by filling the trench with an insulator material. Such a trench may be extended through the insulator layer deposited on the semiconductor substrate.

Moreover, Reference 2 also discloses a plurality of emitter cones partitioned into a block which is surrounded by an insulator material buried in the trench. At any rate, the field emission cold cathode device has a plurality of blocks which are arranged in rows and columns and each of which has a plurality of the emitter cones. In this connection, the field emission cold cathode device of the type mentioned above will be called a block type field emission cold cathode device. As mentioned above, each block may serve to prevent the electric resistance from being lowered and will be called a resistor block.

More specifically, the semiconductor substrate and the insulator layer on the semiconductor substrate are partitioned in Reference 2 into a plurality of blocks by trenches which are embedded by glass, such as BPSG (boro phospho silicate glass). Subsequently, gate electrodes are deposited on the blocks and a plurality of holes are opened on the gate electrodes and the insulator layer within each block. Emitter cones are thereafter formed in the holes to fabricate the block type field emission cold cathode device.

As a result, the gate electrodes surround the emitter cones and have gate electrode openings.

On the other hand, it is necessary to increase an amount of emitted electrons in the block type field emission cold cathode device. In other words, requirements have been made about increasing an emission current. Under the circumstances, it is preferable that the emitter cones are arranged in each block with a high density. Accordingly, a great number of holes are preferably opened in the resistor block and the gate electrodes within each resistor block at a small size with a narrow distance left between adjacent holes. Practically, such holes have sizes and distances both of which are very close to critical sizes and distances determined by a resolution of photolithography. For example, a recent requirement is to open, in each resistor block and gate electrode of ten $\mu$ms square, the holes which have diameters of 0.5 $\mu$m and which are arranged at the distance of 0.5 in rows and columns.

This structure makes it possible to arrange the emitter cones of about one hundred in each resistor block and to realize a large electric current. An increased electric current can be accomplished when a plurality of such resistor blocks are arranged in the form of an array.

As is apparent from the above, the holes should be precisely and finely delineated or formed on the insulator layer and the gate electrodes within each resistor block to accommodate the emitter cones in the holes. This means that the trenches embedded by the BPSG and the gate electrode openings within each resistor block must be also precisely located by the use of a fine processing technique, such as photolithography.

However, it is practically very difficult to precisely form each resistor block as it is designed, due to the resolution of photolithography and the like. This brings about a variation of emission currents emitted from the emitter cones in each resistor block and makes it difficult to obtain a uniform image.

More specifically, the block type field emission cold cathode device is usually manufactured by digging the trenches, by thereafter coating the BPSG, and by making the BPSG re-flow to fill the trenches with the BPSG and to consequently embed the BPSG into the trenches. In this event, the BPSG is inevitably deposited not only within the trenches but also on the other portions than the trenches. Accordingly, superfluous BPSG on the other portions than the trenches must be removed by an etch-back technique.

According to the inventors' experimental studies, it has been found out that trench surfaces of the BPSG embedded in the trenches are not completely flush with surfaces of the other portions after removal of the BPSG but are offset relative to the latter by 0.1 μm or so. Specifically, the former trench surfaces of the BPSG become lower than the other portions by 0.1 μm. This might result from a difference of material properties between the BPSG and the other portions.

When the insulator layer and the gate electrodes are deposited on the BPSG and the other portions with the offset left between the BPSG and the other portions, an inclination or slope is formed between the trench surfaces of the BPSG and edge portions of each resistor block covered with the insulator layer and the gate electrodes. As a result, it has been observed that the edge portions of each resistor block are heaped or raised up relative to the trench surfaces of the BPSG. Especially, when each resistor block has a contour of a polygonal configuration (for example, a square configuration) defined by vertexes and sides, the gate electrodes are highly raised up at the vertexes in comparison with the remaining sides.

Herein, let the holes or openings be dug at such heaped or raised up portions. In this case, the holes or openings are very often irregularly distorted on the heaped up portions from a regular shape. With this structure, it has been experimentally confirmed that electrical short circuit is liable to occur between the gate electrodes and the emitter cones when the emitter cones are formed within the distorted holes or openings.

In addition, it is assumed that the openings or holes are formed by the photolithography in each resistor block by using a mask or a reticle which defines a great number of holes of the same size arranged at an equidistance from one another. In this event, it has been also confirmed that the holes positioned at a peripheral zone of each resistor block and adjacent to the trenches are different in size from the holes which are surrounded by the other holes and which are remote from the trenches.

When the holes for the emitter cones are different in size from one another, the emitter cones have heights dependent on the sizes or diameters of the holes when they are manufactured by the use of the Spindt technique. In other words, the heights of the emitter cones are varied in dependency upon the diameters of the holes, which gives rise to variations of the distances between the gate electrodes and the emitter cones. This shows that the emission currents are also varied among the emitter cones and an optimum operation can not be accomplished with this structure due to the variations of the emission currents.

SUMMARY OF THE INVENTION

It is an object of this invention to provide a field emission cold cathode device which has at least one resistor block and which can substantially uniform emission currents emitted from emitter cones in the resistor block.

It is another object of this invention to provide a field emission cold cathode device of the type described, which can prevent electrical shortening between the gate electrodes and the emitter cones due to variations of hole sizes in each resistor block.

It is still another object of this invention to provide a method of manufacturing a field emission cold cathode device which can emit uniform electrons from the emitter cones formed in the resistor block.

It is yet another object of this invention to provide a method of the type described, which is capable of making gate openings substantially uniform in each resistor block.

A field emission cold cathode device to which this invention is applicable has a plurality of emitter cones arranged within the respective holes formed in a zone of a predetermined shape surrounded by a predetermined contour. The predetermined contour has a first partial contour of a first radius of curvature and a second partial contour of a second radius of curvature not smaller than the first radius of curvature. The holes having a first hole defined by a first minimum distance between an edge of the first hole and the first partial contour and at least one second hole close to the second partial contour and defined by a second minimum distance between an edge of the second hole and the second partial contour.

According to an aspect of this invention, the first minimum distance is not shorter than the second minimum distance and is specifically greater than the second minimum distance.

According to another aspect of this invention, a field emission cold cathode device has a block surrounded by a contour of a predetermined shape and a plurality of holes which are arranged in the block and which are divided into a series of outermost holes nearest to the contour and inner holes located within the outermost holes. The block is partitioned by a peripheral hole line virtually drawn in the block at an equal distance to the contour. The outermost holes are arranged inside the peripheral hole line and do not exceed the peripheral hole line.

According to still another aspect of this invention, a method is for use in manufacturing a field emission cold cathode device having a block surrounded by a contour of a predetermined shape and a plurality of holes in the block. The method comprises preparing a mask which has mask patterns of a predetermined shape and forming the holes of a shape different from the predetermined shape of the mask patterns. The predetermined shape is polygonal while the shape of the holes is circular.

According to yet another aspect of this invention, a method is for use in manufacturing a field emission cold cathode device having a block surrounded by a contour and a plurality of holes which are arranged in the block and which are divided into a series of outermost holes nearest to the contour and inner holes located within the outermost holes. The method comprises preparing a mask which has first mask patterns for the outermost holes and second mask patterns which are different in size from the first mask patterns to form the inner holes and forming the outermost and the inner holes substantially equal in size to each other.

DESCRIPTION OF THE PREFERRED EMBODIMENTS

Figure 1:
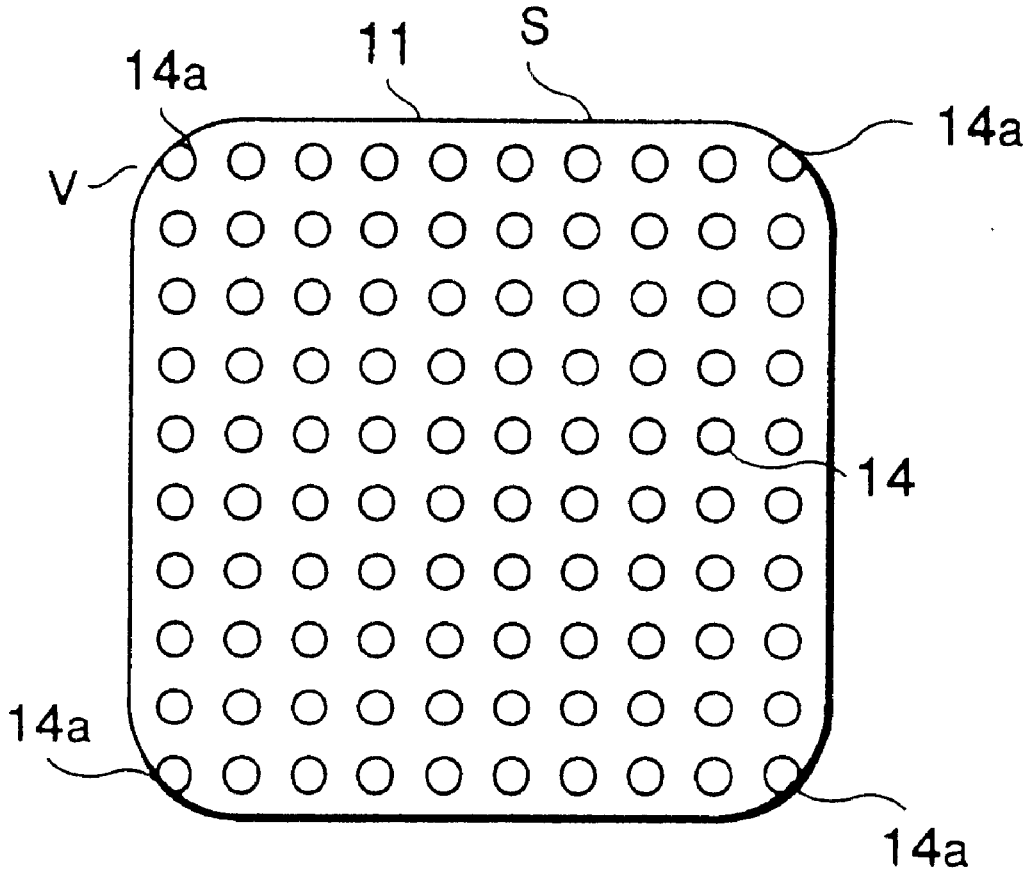
FIG. 1 PRIOR ART
FIG. 1 shows a partial plan view of a conventional field emission cold cathode device.

Referring to FIG. 1, description will be made about a conventional field emission cold cathode device for a better understanding of this invention. It is to be noted that gate electrodes are omitted from FIG. 1 for brevity of description. In this figure, a plurality of resistor blocks 11 are arranged and individually separated from one another by a trench. In other words, each resistor block 11 is surrounded by the trench and has a plurality of holes 14 in which emitter cones are deposited, respectively, although not shown in FIG. 1. Each resistor block 11 illustrated in FIG. 1 has a substantially square shape which has four vertexes V and four sides S when it is broadly seen on a plane, although each vertex V is somewhat precisely rounded, as shown in FIG. 1. Thus, the illustrated resistor block 11 is specified by a contour of a substantially square shape and defines a zone surrounded by the contour.

To be precise, each vertex V of the resistor blocks 11 has a radius of curvature, as illustrated in FIG. 1, due to a critical resolution of the photolithography used to separate the resistor blocks 11 by the trench, an isotropic component appearing on dry etching, and an isotropic component appearing on thermal oxidation.

Moreover, it is readily understood that the radius of curvature at each vertex V can not be completely rendered into zero and inevitably has a finite radius of curvature practically. On the other hand, each side S illustrated in FIG. 1 is formed by a straight line which has an infinite radius of curvature.

Taking this into consideration, a zone adjacent to each vertex V might be referred to as a first portion which has the finite radius of curvature while the remaining zone adjacent to each side S might be referred to as a second portion which has the infinite radius of curvature.

Although not shown in FIG. 1, it should be practically considered that heaped up portions, namely, offsets appear on each resistor block 11 close to the BPSG embedded in the trench. Especially, the heaped up portions become high at the portions, such as vertex (V) portions contiguous to both the sides S, which are surrounded by the trench. However, the remaining zone of each resistor block 11 has a very flat surface.

Now, let the holes be dug at an equidistance in rows and columns within each resistor block 11 to locate the emitter cones within the holes.

As illustrated in FIG. 1, holes 14*a* closest to the vertex (V) portions of the illustrated resistor block 11 are distorted from the remaining holes 14. In other words, the holes 14*a* are irregularly distorted or warped within the first portion adjacent to each vertex V. Such distorted holes 14*a* might bring about the shortcomings mentioned in the preamble of the instant specification, when the emitter cones are formed within the distorted holes 14*a*.

Figure 2:
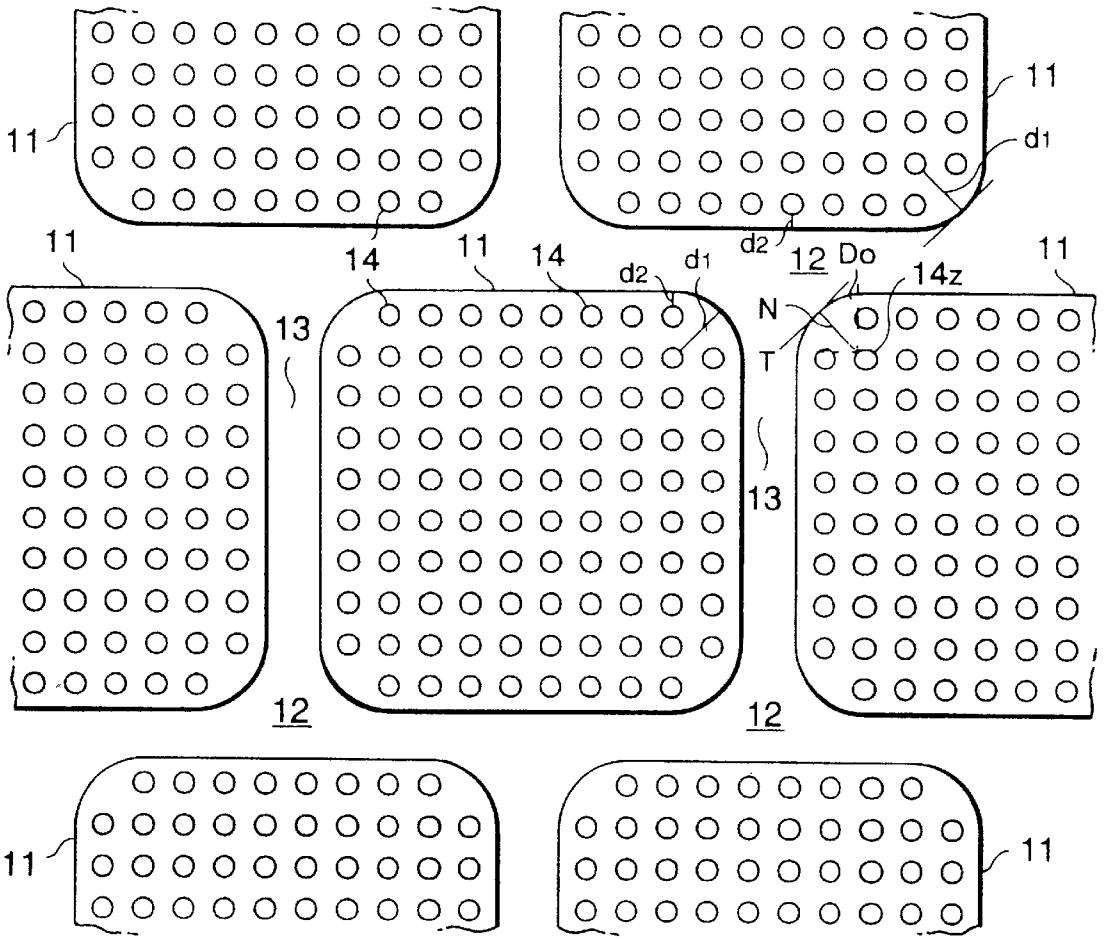
FIG. 2 is a plan view for use in describing a field emission cold cathode device according to a first embodiment of this invention.

Referring to FIG. 2, a field emission cold cathode device according to a first embodiment of this invention is of a block type as mentioned before and has a plurality of resistor blocks 11 separated or isolated by a trench 12 from one another. The illustrated trench 12 is dug in a depth direction to a substrate, for example, a semiconductor substrate which underlies the resistor blocks 11. In addition, the trench 12 is filled with an insulator material, such as BPSG, polysilicon. In the illustrated example, three rows of the resistor blocks 11 are arranged which are composed of an upper row, a center row, and a lower low and which have a substantial square shape of the same size. It is to be noted that the resistor blocks 11 in the center row are displaced or shifted in a horizontal direction of FIG. 1 from those in the upper and the lower rows by a half of a width of each resistor block 11.

As shown in FIG. 2, each resistor block 11 has a contour or a configuration line. The contour of each resistor block 11 is divided into first partial contours which are equal in number to four and which have finite radii of curvature and second partial contours which are equal in number to four and which have infinite radii of curvature. The first and the second partial contours may be made to correspond to vertexes V and sides S of the substantial square shape of each resistor block 11, respectively. In other words, the surface or zone of each resistor block 11 can be partitioned into first partial zones surrounded by the first partial contours and second partial zones except the first partial zones. The illustrated resistor block 11 and the trench 12 have practically an area of 10×10 $\mu$ms and a width of 1.5$\mu$ms.

In the illustrated example, each of the resistor blocks 11 has a plurality of holes 14 each of which is arranged in rows and columns to locate an emitter cone (not shown) one by one. The number of the holes 14 in the illustrated resistor block 11 is equal to ninety-eight. Herein, it is to be noted in the illustrated example that four of the holes which are adjacent to the four vertexes are removed from the first partial zones, respectively, in consideration of the radii of curvature at the four vertexes. As a result, any distorted holes are removed from each resistor block 11 and the holes 14 of normal circular shapes alone are left on each resistor block 11. This structure serves to prevent the emitter cones from being formed in the distorted holes and to avoid variations of emission currents.

Practically, the diameter of each hole 14 and a distance between two adjacent ones of the holes 14 are equal to 0.5 and 0.5 $\mu$m, respectively. When the holes 14 are arranged at an equal distance in rows and columns, a pitch of the holes 14 can be defined by a distance between center points of two adjacent holes. In the illustrated example, the pitch of the holes 14 becomes equal to 1 $\mu$m.

In order to facilitate an understanding of this invention, description will be made about a method of manufacturing the field emission cold cathode device illustrated in FIG. 1.

At first, a silicon substrate which has a principal surface is prepared as a substrate. After provision of the silicon substrate, a surface insulator layer of, for example, $SiO_2$ and/or $Si_3O_4$, is deposited on the principal surface of the silicon substrate and is selectively etched by using a photoresist film as a mask to define a portion of the trench 12. Subsequently, the trench 12 is further dug in the depth or vertical direction to a predetermined depth of the silicon substrate by the use of a reactive ion etching (RIE) technique. Thus, the silicon substrate is partitioned into a plurality of the resistor blocks 11 by the trench 12.

After the trench 12 is dug to the silicon substrate, the insulator layer such as a BPSG layer depicted by 13 in FIG. 2 is deposited to a preselected thickness within the trench 12. Consequently, the BPSG layer 13 is embedded in the trench 12 and is caused to reflow by a heat treatment to flatten a surface of the BPSG layer 13.

The BPSG layer 13 is etched out by the etch back technique or the like with the BPSG layer 13 left in the trench 12 to selectively expose the surface insulator layer. On the surface insulator layer, a gate electrode layer is deposited by evaporation or the like. In this case, the gate electrode layer may be formed by Mo, W, WSi, or the like.

After deposition of the gate electrode layer, a plurality of the minute holes 14 are dug as shown in FIG. 2 by selectively etching the gate electrode layer and the surface insulator layer to the silicon substrate by the RIE technique within each resistor block 11 surrounded by the trench 12. Thus, the silicon substrate is selectively exposed by the etching. Thereafter, emitter cones are formed in a known manner, such as the Spindt method, in the respective holes 14.

In the above-mentioned manner, the vertex portions, namely, the first partial contours of each resistor block 11 are inevitably rounded during formation of the trench 12 and the like. Under the circumstances, the holes are intentionally removed from the first partial zones in this invention, as illustrated in FIG. 2. Thus, the field emission cold cathode device according to this invention is advantageous in that electrons are uniformly emitted from each resistor block 11.

In the illustrated example, the contour of each of the resistor blocks 11 defined by the trench 12 is composed of the first partial contour and the second partial contour contiguous to the first partial contour. However, this invention is not always restricted to each resistor block which has the first and the second partial contours defined by the finite and the infinite radii of curvature, respectively, but may be structured by each resistor block which has the first and the second partial contours defined by the first and the second finite radii of curvature. In this event, the first finite radius of curvature is not greater than the second finite radius of curvature. Actually, the second partial contour has the second radius of curvature which may be finite but may be greater than the first radius of curvature of the first partial contour, although description will be made hereinafter about the second radius of curvature which is infinite.

In FIG. 2, it should be considered that a minimum distance between the second partial contour and the holes is determined by a distance measured along a line normal to the second partial contour from an edge of the holes 14 nearest to the second partial contour and a line normal to the second partial contour.

Likewise, consideration should be also made about a minimum distance between the first partial contours having the radius of curvature and the holes 14 nearest to the first partial contour. To be precise, each minimum distance between the first partial contours and the nearest holes can be determined by considering a line N normal to a tangential line T drawn at the first partial contour. Specifically, each minimum distance is given by a distance between the first partial contour and an edge of the nearest one of the holes arranged in the direction of the normal line N. In the example being illustrated, a sectorial domain, namely, a quadrant Do is defined in relation to the first partial contour. Under the circumstances, the tangential line T is drawn at a center of the first partial contour and the line N is normal to the tangential line T and may be called the normal line. In addition, the nearest hole 14*z* is determined along the normal line N. Taking the above into account, a distance d1 is defined as the minimum distance d1 by a length of the normal line N to the edge of the nearest hole 14*z*. Hereinafter, the minimum distance d1 will be called a first minimum distance while the sectorial domain Do surrounded by the first partial contour may be referred to as a partial zone.

Moreover, it may be found out that the sectorial domain Do partially may include any other holes placed on an upper side and a left side of the nearest bole 14*z* in addition to the nearest hole 14*z*. However, the other holes have minimum distances determined in relation to the second partial contours and may be neglected on calculating the first minimum distance. This is because the other holes except the nearest hole 14*z* can have regular shapes regardless of the radii of curvature of the first partial contours.

At any rate, it is possible to determine the first minimum distance d1 by the shortest one of the normal line N that passes through centers of the holes 14.

Next, the distances between the second partial contours and the holes 14 will be considered in each resistor block 11. In the illustrated example, a minimum or shortest one of the distances between the second partial contours and the nearest one of the holes 14 may be represented by d2 and may be called a second minimum distance. Specifically, the second minimum distance d2 is determined in consideration of distances between a line normal to each side line of the resistor block 11 and the edge of the hole 14 nearest to each side and may be defined by the shortest distance among the above-mentioned distances. The first minimum distance d1 may not be considered in connection with the holes which define the second minimum distance d2, as mentioned above.

Although the first minimum distance d1 is longer than the second minimum distance d2 in the illustrated example, a relationship between the first and the second minimum distances d1 and d2 may be decided in dependency upon the contour of each resistor block 11. For example, the first minimum distance d1 may be equal to the second minimum distance d2.

In another way, the illustrated device is structured so that no hole is arranged within the first partial zones, namely, the sectorial domains Do surrounded by the first partial contours while the holes 14 are arranged only in the remaining zone except the first partial zones. This means that distribution densities of the holes are different in the first partial zones Do and the remaining zone from each other. In the illustrated example, the distribution density of the holes 14 in the first partial zones Do is lower than that of the holes 14 in the remaining zone by removing the holes from the first partial zones Do.

Figure 3:
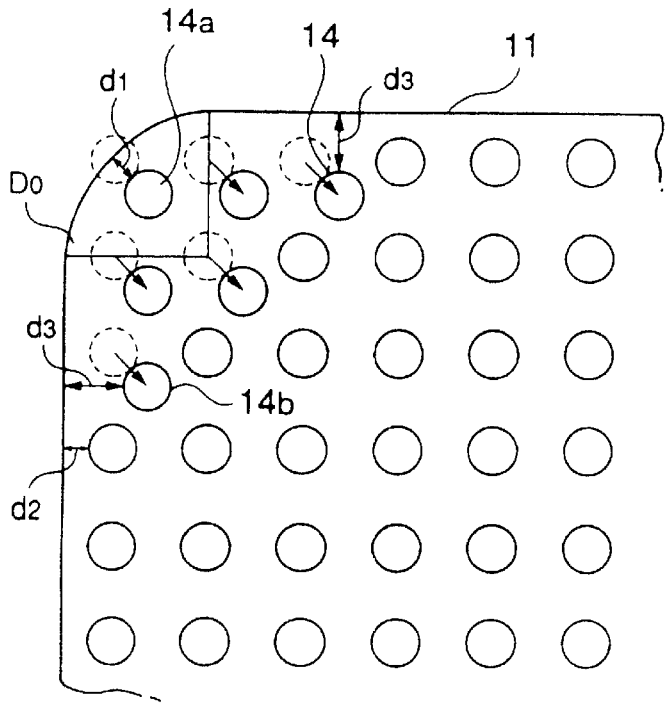
FIG. 3 is a partial plan view for use in describing a modification of the field emission cold cathode device illustrated in FIG. 2.

Referring to FIG. 3, a modification of the field emission cold cathode device according to the first embodiment of this invention has a plurality of holes which are to be arranged in each first partial zone Do and its neighborhood, as depicted by broken lines and which are shifted inwardly of the resistor block (as depicted by arrowheads) to inside positions (shown by real lines). With this structure, a hole distribution density of the holes 14 in each first partial zone Do and its neighborhood is locally higher than that of the holes 14 in the other zone. In this case, the first minimum distance d1 between the first partial contour and the nearest hole 14*a* in the first partial zone Do is longer than the second minimum distance d2 determined in relation to the second partial contour and its neighboring holes.

Specifically, the hole (depicted by the broken line) which is nearest to the first partial contour is shifted inside the resistor block along with six holes (depicted by the broken lines) adjacent to the nearest hole. Each of the shifted holes is shown by the real lines. This arrangement which partially or locally shifts the hole or holes does not need to reduce the number of the holes, differing from the arrangement illustrated in FIG. 2.

With this structure, each first partial zone Do which is defined by the first partial contour and a center of curvature becomes locally low in hole distribution density as compared with its neighboring zone, as readily understood from FIG. 3. This structure can also avoid occurrence of distorted or warped holes. In addition, the shifted hole 14*b* which is adjacent to the first partial zone Do is remote from the second partial contour by a minimum distance d3. The minimum distance d3 illustrated in FIG. 3 is longer than the second minimum distance d2 but may be equal to the latter.

Figure 4:
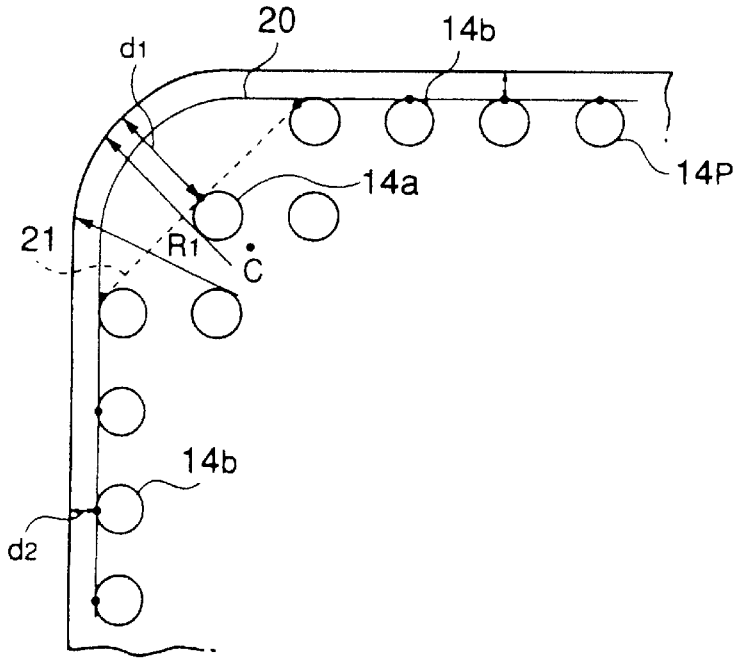
FIG. 4 is a partial plan view for use in describing another modification of the field emission cold cathode device illustrated in FIG. 2.

Referring to FIG. 4, another modification of the field emission cold cathode device according to the first embodiment of this invention is directed to a peripheral line 20 which connects points of the outermost holes that define the second minimum distances d2 in the resistor block. At the first partial contour having the finite radius of curvature, the peripheral line 20 is drawn at an equidistance relative to the first partial contour, as shown in FIG. 4 and may be referred to as a hole peripheral line. In FIG. 4, the arrangement of the holes is determined in consideration of the hole peripheral line.

More specifically, an equidistance is also substantially kept between the illustrated hole peripheral line 20 and the second partial contour. In other words, the outermost holes 14*b* adjacent to the second partial contour are arranged in line so that the points which define the second minimum distance d2 are arranged in parallel with the second partial contour.

In the first partial zone which is defined by both the first partial contour and the center of curvature, the hole peripheral line has a virtually equal distance relative to the first partial contour, as mentioned before. Moreover, an additional hole peripheral line 21 (shown by a broken line) is drawn by connecting outer peripheries of three outermost holes adjacent to the first partial zone. As illustrated in FIG. 4, the outermost holes 14*a* and the like in the first partial zone are located inside the hole peripheral line 20 together with the other outermost holes arranged along the second partial contour.

In other words, all of the outermost holes 14*a* and 14*b* are located inside the hole peripheral line 20 in the resistor block. The illustrated distance between the contour and the virtual hole peripheral line 20 is equal to the second minimum distance d2 which is mentioned in connection with the holes 14*b* adjacent to the second partial contour.

In the illustrated example, the first minimum distance d1 is determined between the first partial contour and the outermost hole 14*a* in the first partial zone and is longer than the second minimum distance d2. However, the outermost hole 14*a* in the first partial zone may be shifted outwards of the resistor block until the first minimum distance d1 becomes equal to the second minimum distance d2. In this event, the additional hole peripheral line 21 is coincident with the hole peripheral line 20.

Thus, each of the outermost holes 14*a* and 14*b* may be located along the hole peripheral line 20, This means that the contour which is composed of the first and the second partial contours may not be restricted to a square shape but may be shaped into an optional configuration, such as a parallelogram, a trapezoid, a triangle, a pentagon, a hexagon, an octagon. Moreover, the contour may not have any vertexes but may be formed by a curved line without any vertexes. In any event, the contour may have the first partial contour of the finite radius of curvature and the second partial contour having the radius of curvature which is different from that of the first partial contour and which is practically infinite in the above-numerated polygon.

Figure 5:
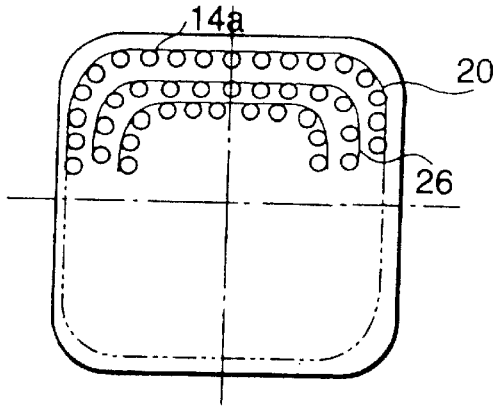
FIG. 5 is a plan view for use in describing a field emission cold cathode device according to a second embodiment of this invention.

Referring to FIG. 5, a field emission cold cathode device according to a second embodiment of this invention is specified by a single resistor block which has a contour of a square shape and which has a great number of holes 14 arranged therein. The holes have a series of outermost holes which is nearest to the contour and which may be called a series of peripheral holes 14*a*. The series of the peripheral holes 14*a* can be connected to one another by a hole peripheral line 20 in the manner mentioned in FIG. 4. All of the peripheral holes 14*a* are arranged along the hole peripheral line 20 which is drawn at an equidistance relative to the contour.

In the illustrated example, internal ones of the holes that are arranged inside the peripheral holes 14*a* within the resistor block 11 may be referred to as internal holes. The internal holes may be arranged along internal peripheral lines each of which is drawn at an equidistance relative to the hole peripheral line 20.

As mentioned in conjunction with FIG. 4, the outermost hole 14*a* in each first partial zone surrounded by the first partial contour of the finite radius of curvature may be located inside the hole peripheral line 20 which is shown in FIG. 4 and which is drawn at the equidistance relative to the contour. Taking this into consideration, the contour of the resistor block may be of a circle having a center. In this case, the series of the holes may be arranged along the hole peripheral line of a concentric circle shape which has the center of curvature at the center of the circle. Likewise, an inner series of the holes is also arranged along an inner hole peripheral line concentrically drawn inside the hole peripheral line. Thus, all of the holes may be located along a plurality of concentric circles in this example.

Figure 6:
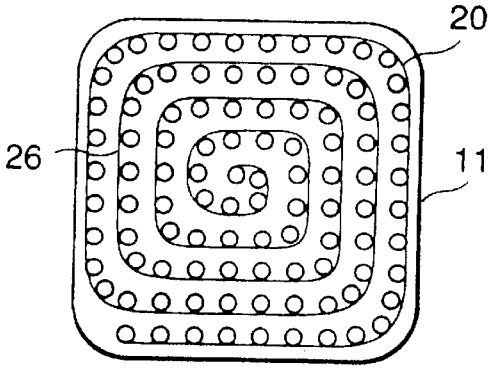
FIG. 6 is a plan view for use in describing a field emission cold cathode device according to a third embodiment of this invention.

Referring to FIG. 6, a field emission cold cathode device according to a third embodiment of this invention is specified by a hole peripheral line 20 virtually drawn in FIG. 6 and an inner peripheral line 26 which is virtually drawn also and which is contiguous to the hole peripheral line 20 Herein, an equidistance is kept between the hole peripheral line 20 and the contour of the resistor block, like in the other figures. The outermost holes are arranged along the hole peripheral line 20. On the other hand, the inner peripheral line 26 which is contiguous to the hole peripheral line 20 is drawn in a spiral shape, as illustrated in FIG. 6. The inner holes are located along the inner peripheral line 26 of the spiral shape.

With this structure, it is possible to avoid a reduction of a hole distribution density in each first partial zone surrounded by each first partial contour and to also prevent the hole from being distorted in each first partial zone. Accordingly, this structure is also effective to reduce a variation of the current density in each resistor block. The contour of the square shape may be replaced by another configuration, for example, a triangle shape or the like.

Figure 7:
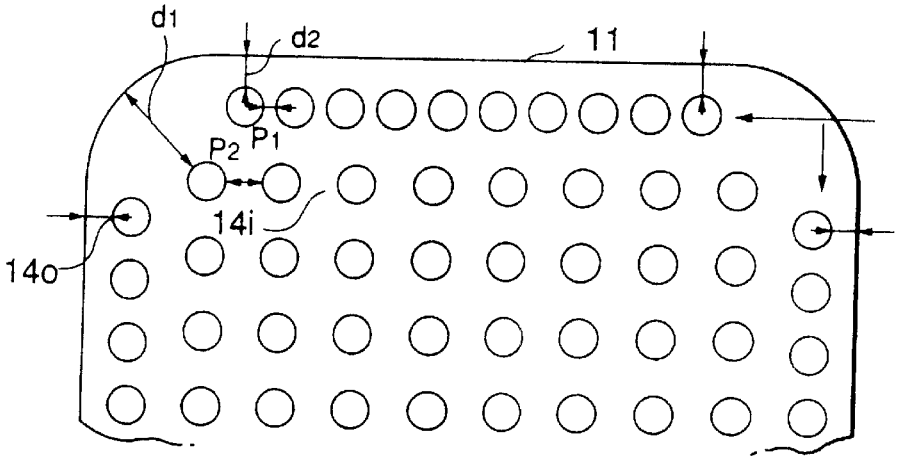
FIG. 7 is a plan view for use in describing a field emission cold cathode device according to a fourth embodiment of this invention.

Referring to FIG. 7, a field emission cold cathode device according to a fourth embodiment of this invention has a resistor block of a square shape specified by a square contour composed of first partial contours of a finite radius of curvature and second partial contours of an infinite radius of configuration. This device has a plurality of holes which are grouped into outermost holes 14*o* and inner holes 14*i* surrounded by the outermost holes 14*o*. The outermost holes 14*o* are nearest to the contour and lined up along the contour in horizontal and vertical directions at an equidistance between adjacent ones of the outermost holes 14*o*. In other words, the outermost holes 14*o* are arranged with a first space gap p1 left between two adjacent ones of the outermost holes 14*o* and are remote from the contour by the distance d2 measured in the manner mentioned above.

Herein, it is noted that no outermost hole is arranged within each first partial zone as a result of removing a hole from each first partial zone.

On the other hand, the inner holes 14*i* are also arranged in rows and columns within a zone surrounded by the outermost holes 14*o* and located at a second space gap p2 left between two adjacent ones of the inner holes 14*i*. Specifically, the first space gap p1 is different from the second space gap p2 and is shorter than the latter in the illustrated example. In this connection. the number of the outermost holes 14*o* arranged in the row direction is equal to ten while the number of the inner holes 14*i* arranged in the row direction is equal to eight when omission is made about two of the outermost holes 14*o* placed outside the inner holes 14*i*.

At any rate, this structure makes it possible to avoid a reduction of a hole distribution density in each first partial zone surrounded by each first partial contour. Like in the first and the space gaps p1 and p2, first and second pitches can be defined about the outermost and the inner holes 14*o* and 14*i*, respectively, and are given by distances between two adjacent holes, respectively The first and the second pitches have the same relationship as the first and the second space gaps p1 and p2, respectively.

As shown in FIG. 7, the first partial zone is defined by the first partial contour of the finite radius of curvature and the center of curvature and has the hole distribution density lower than the remaining zone. As a result, the first minimum distance d1 given in the first partial zone in the above-mentioned manner is longer than the second minimum distance d2.

Figure 8:
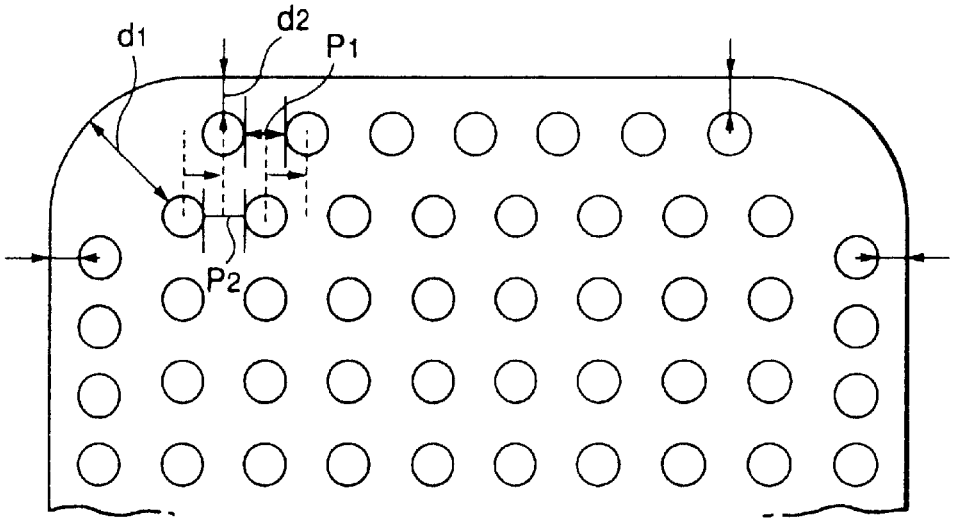
FIG. 8 is a plan view for use in describing a modification of the field emission cold cathode device illustrated in FIG. 7.

Referring to FIG. 8, a modification of the field emission cold cathode device according to the fourth embodiment has the outermost holes 14*o* arranged at the first space gap p1 and the inner holes 14*i* arranged at the second space gap p2, like in FIG. 7. Likewise, no hole is arranged in the first partial zones surrounded by the first partial contours. However, it is to be noted that the first space gap p1 is equal to the second space gap p2 and the number of the outermost holes 14*o* is reduced in comparison with the number of the outermost holes 140 illustrated in FIG. 7. In addition, the outermost holes 14*o* is shifted in the row or the column direction relative to the inner holes 14*i* by a distance equal to a half of the first (or the second) space gap p1 (or p2), as readily understood from FIG. 8. This applies to a relationship between the first and the second pitches mentioned in connection with the outermost and the inner holes 14*o* and 14*i* in FIG. 7. Specifically, the outermost holes 14*o* are shifted in the row or the column direction by a half pitch relative to the inner holes.

In FIG. 8, no hole is arranged in each first partial zone defined by each partial contour and the center of curvature. With this structure, the first minimum distance d1 between the first partial contour and the nearest whole is also longer than the second minimum distance d2 between the second partial contour and each outermost hole.

Figure 9:
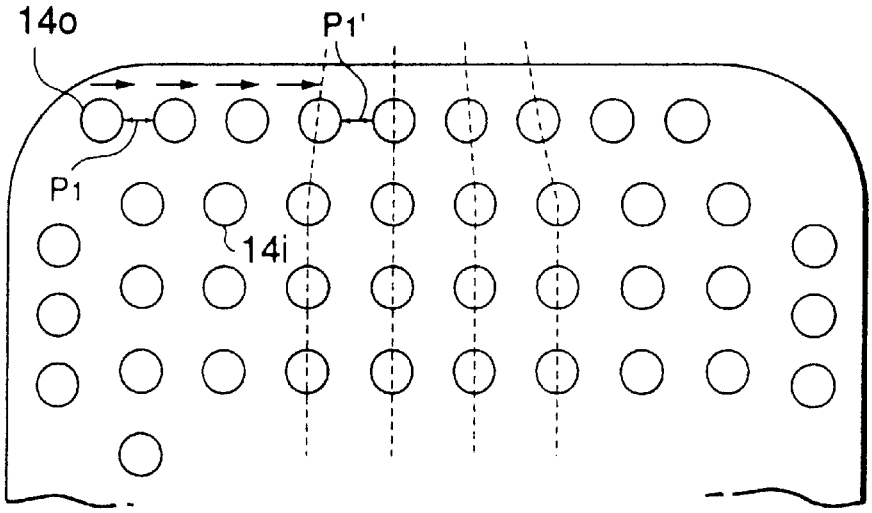
FIG. 9 is a plan view for use in describing another modification of the field emission cold cathode device illustrated in FIG. 7.

Referring to FIG. 9, another modification of the field emission cold cathode device according to the fourth embodiment of this invention has outermost holes 14*o* arranged along a single row and a single column. Briefly, space gaps of the outermost holes 14*o* are changed in the single row or column. In FIG. 9, two adjacent ones of the outermost holes 14*o* that are close to the first partial zone are arranged with a first local space gap p1 while the outermost holes 14*o* at the center of the row are arranged with a second local space gap p1' which is different from the first local space gap p1. In the illustrated example, the first local space gap p1 is narrow as compared with the second local space gap p1'. This structure makes it possible to arrange no hole in each first partial zone determined by each first partial contour.

In addition, the second space gap p2 between the inner holes 14*i* is not changed in the example. This arrangement does not need to reduce the number of the holes formed within the resistor block.

According to the embodiments mentioned above, it is possible to form the holes of the uniform shapes by arranging no hole in the first partial zones defined by the first partial contours having the finite radius of curvature. Consequently, it is possible to obtain the field emission cold cathode device which can avoid shortening between the emitter cones and the gate electrodes and which can reduce a variation of electric currents in each resistor block. This results in improvement of reliability and yield of the field emission cold cathode device.

In the above-mentioned examples, the contour of each resistor block has been determined by the material, such as BPSG, embedded in the trench. However, the contour of the resistor block may be determined by any other material.

In the meanwhile, the field emission cold cathode device according to this invention is manufactured by forming each resistor block partitioned by the trench. Such a trench is made up by selectively etching the insulator layer and the semiconductor substrate by the use of the photolithography technique. Furthermore, an insulator material is embedded in the trench and is selectively removed from a region of the insulator layer. Thereafter, the gate electrode is deposited on the insulator layer and is selectively etched together with the insulator layer to form a plurality of holes in each resistor block partitioned by the trench. Subsequently, the emitter cones are deposited within the holes.

Herein, it is to be noted that the photolithography technique is used on forming the holes. Such holes are usually formed by exposing photoresist of, for example, a positive type coated on the gate electrode formed on the insulator material embedded in the trench. It is assumed that a mask is used which has a white portion corresponding to the holes and a black portion corresponding to the remaining portion.

Figure 10A:
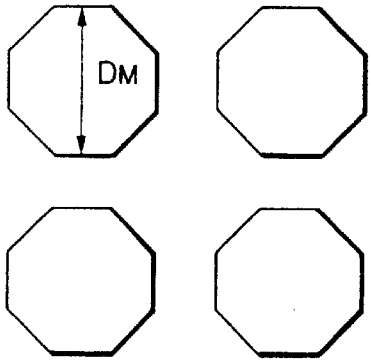
FIGS. 10A and 10B show a relationship between mask patterns and photoresist patterns which are formed on a mask and photoresist, respectively.
Figure 10B:
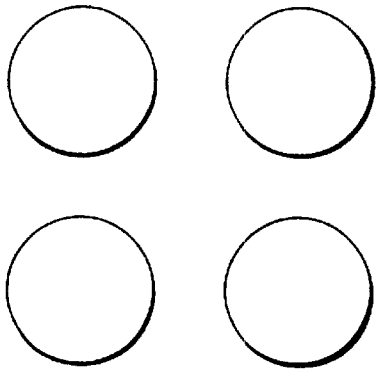

Referring to FIG. 10A, the mask is exemplified which has mask patterns composed of a plurality of polygons (octagons) corresponding to the holes. When such mask patterns of the polygons are transcribed and developed onto the photoresist through an optical system, photoresist patterns as shown in FIG. 10B are obtained which are composed of circles each of which has a diameter of about 0.8 $\mu$m. It has been confirmed that such photoresist patterns of circles are different in sizes from one another in dependency upon the positions of the photoresist patterns.

This means that the mask patterns can not be precisely transcribed as the photoresist patterns as they approach an optical limit in size. As a result, the photoresist patterns are different in configuration and in size from the mask patterns.

Another aspect of this invention is to effectively utilizes the above-mentioned phenomenon so as to form photoresist patterns of circular shapes from mask patterns different from the circular shapes.

According to the inventors' experimental studies, it has been confirmed that the circular photoresist patterns (as shown in FIG. 10B) can be also attained by using mask patterns of square shapes, hexagonal shapes, which will be called polygonal mask patterns hereinafter.

Thus, it is very effective to form the circular photoresist patterns by the use of the polygonal mask patterns on obtaining the circular photoresist patterns by a CAD (Computer Aided Design) technique. More particularly, it is to be noted that an amount of data for specifying the circles considerably becomes large as compared with an amount of data for specifying the polygon. Under the circumstances, it is readily understood that the amount of data can be greatly reduced on using the CAD technique when the polygonal mask patterns can be used to form the circular photoresist patterns, as illustrated in FIGS. 10A and 10B.

In general, it is preferable that the holes are dug in each resistor block as large as possible and have diameters as small as possible in order to lower an operation voltage of the field emission cold cathode device and to improve the resolution. These requirements can be accomplished by the use of the above-mentioned method which obtains the circular photoresist patterns from the polygonal mask patterns.

Furthermore, the square or the rectangular shape can be represented by a minimum amount of data because an angle of each vertex is equal to 90 degrees. This shows that the mask patterns of the square or the rectangular shapes are most preferable in view of a reduction of the amount of data used in the CAD.

It has been also confirmed that intentional displacement of a focus of an optical system make it possible to form the circular photoresist patterns from the polygonal mask patterns.

Now, the present inventors have studied that the holes in each resistor block are not precisely uniform, as mentioned before, but are varied in size, depending on the positions of the mask patterns. In other words, it has been found out that, when a great number of the mask patterns (for example, the polygonal mask patterns) of the same size are formed on a mask, the photoresist patterns are different in size from one another.

Herein, description will be made about the resistor block which is defined by a trench having a contour of a square shape, although this invention is applicable to a device which has no trench. The contour of the square shape is defined by four vertexes and four sides contiguous to two of the vertexes. At first, it is assumed that exposure is made by using a mask which has the same mask patterns arranged in rows and columns. For brevity of description, the radius of curvature at each vertex is assumed to be equal to zero. In this event, the mask patterns are also formed at a region which is nearest to each vertex.

Herein, let photoresist patterns be formed by using the above-mentioned mask. In this event, it has been found out that one of the photoresist patterns for the hole nearest to each vertex of the resistor block that may be called a specific photoresist pattern has a smallest diameter in spite of the fact that the mask patterns themselves are identical in size with one another. Furthermore, the photoresist patterns for the outmost holes nearest to each side portion of the square contour are greater in size than the specific photoresist pattern by about 10% and are smaller in size than the photoresist patterns for the inner holes by about 10%. In other words, when the mask has the same mask patterns and is used to form the photoresist patterns for the holes, the photoresist patterns for the inner holes are greater in size than those for the outermost holes and the specific photoresist patterns are smaller than the photoresist patterns for the remaining outermost holes.

This phenomena might be considered due to the fact that the mask patterns for the outermost holes which are not surrounded by any other mask patterns for the holes are rarely influenced by optical leakage from adjacent mask patterns, namely, optical proximity effect. Such optical proximity effect influences the inner holes strongly, the outermost holes moderately, and the vertex holes weakly.

Figure 11A:
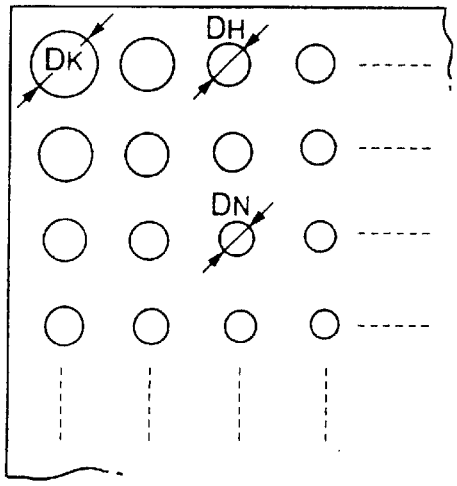
FIGS. 11A and 11B show a size relationship between mask patterns and holes which are formed by the use of the mask patterns shown in FIG. 11A.

Referring to FIG. 11A, description will be made about a method of manufacturing a field emission cold cathode device according to another embodiment of this invention. In FIG. 11A, a mask alone is illustrated which has a plurality of circular mask patterns for brevity of description. Such mask patterns may be polygonal, as described in conjunction with FIG. 10.

In the example illustrated in FIG. 11A, diameters of the mask patterns are depicted by DK, DH, and DN which correspond to the diameter of the mask pattern for the vertex hole, the diameters of the mask patterns for the outmost holes nearest to each side, and the diameters of the mask patterns for the inner holes, respectively. A relationship among the diameters DK, DH, and DN is given by DK>DH>DN. Herein, the diameter DK is greater than the diameter DH by 10% or so while the diameter DH is greater than the diameter DN by about 10%.

Alternatively, when the contour has no vertex, the diameter DK may be neglected.

Figure 11B:
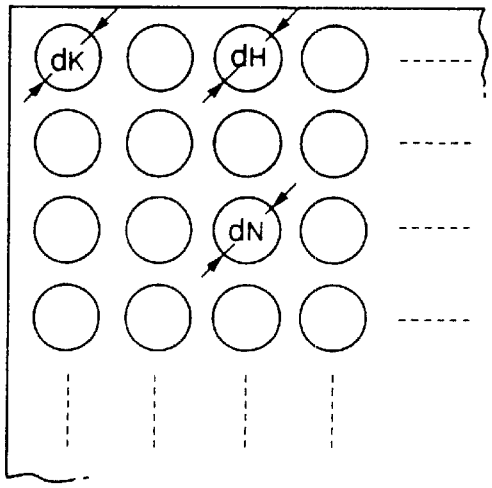

In FIG. 11B, holes are illustrated which are formed by using the mask shown in FIG. 11A and which are located at the vertex portion, the side portions, and the inner portions. The holes have diameters dK, dH, and dN at the vertex, the side, and the inner portions, respectively.

When the mask which has the mask patterns shown in FIG. 11A is used and exposed, it has been confirmed that the diameters dK, dH, and dN are substantially identical with one another. Practically, the diameters dK, dH, and dN are equal to 0.5 $\mu$m. The mask patterns of different sizes may be delineated on a reticle. Thus, exposed patterns of the same size can be obtained by using the mask or the reticle which has patterns of different sizes, in consideration of the optical proximity effect.

The above-mentioned description has been made about the resistor block which has the holes of about one hundred arranged at the distance of 0.5 $\mu$m. However, this invention is also applicable to the case where the holes are formed more than one hundred, where the holes are arranged at the distance of 0.8 $\mu$m, and where each hole has the diameter greater than 0.5 $\mu$m.

While this invention has thus far been described in conjunction with several embodiments thereof, it will readily be possible for those skilled in the art to put this invention into practice in various other manners. For example, this invention may arrange only uniform holes regardless of a contour of each block. To this end, distorted holes may be removed from each block or may not be arranged. At any rate, it is possible to form uniform emitter cones and to thereby uniform a current density from each block.

What is claimed is:

1. A field emission cold cathode device comprising:

an insulating block;

a plurality of holes arranged in the insulating block; and an emitter cone disposed in each of the holes;

wherein the holes are arranged to be in a rectangular grid having perpendicular rows and columns, except that a plurality of holes arranged in each corner of the grid are displaced from positions on the grid toward a center of the grid.

2. The field emission cold cathode device of claim 1, wherein in each said corner, six of the holes are displaced toward the center.

3. A field emission cold cathode device comprising:

an insulating block;

a plurality of holes arranged in the insulating block; and an emitter cone disposed in each of the holes;

wherein the holes are arranged in a plurality of concentric rectangles, except that at least one said hole in each corner of each said concentric rectangle is displaced toward a center of the insulating block.

4. A field emission cold cathode device comprising:

an insulating block;

a plurality of holes arranged in the insulating block; and an emitter cone disposed in each of the holes;

wherein the holes are divided into interior and exterior holes, the interior holes being arranged into a rectangular grid, the exterior holes being arranged into four exterior rows and lying outside of the interior holes and along respective edges of the rectangular grid, each of the exterior rows having a total length less than a length of a corresponding edge of the rectangular grid.

5. The field emission cold cathode device of claim 4, wherein a number of the exterior holes making up each of the exterior rows is greater than a number of the interior holes making up a nearest row of the interior holes.

6. The field emission cold cathode device of claim 5, wherein a number of the exterior holes making up at least one of the exterior rows is two greater than a number of the interior holes making up a nearest row of the interior holes.

7. The field emission cold cathode device of claim 4, wherein a number of exterior holes in each of the exterior rows is one less than a number of interior holes in a nearest row of the interior holes.

8. The field emission cold cathode device of claim 7, wherein a distance separating immediately adjacent said exterior holes within at least one of the exterior rows and a distance separating immediately adjacent said interior holes within a nearest row of the interior holes is the same.

9. The field emission cold cathode device of claim 4, wherein the exterior holes in each of the exterior rows are arranged so that immediately adjacent said exterior holes near a center of the exterior row are farther from one another than are the exterior holes nearer an end of the same exterior row.

* * * * *